United States Patent [19]

Mizobuchi et al.

[11] Patent Number: 4,735,860

[45] Date of Patent: Apr. 5, 1988

[54] HEAT-RESISTANT, THERMAL-SENSITIVE TRANSFER SHEET

[75] Inventors: Akira Mizobuchi; Yoshiaki Hida; Shigeki Umise, all of Tokyo; Kyoichi Yamamoto; Kyohei Takahashi, both of Sagamihara, all of Japan

[73] Assignee: Dai Nippon Insatsu Kabushiki Kaisha, Japan

[21] Appl. No.: 805,797

[22] Filed: Dec. 6, 1985

[51] Int. Cl.[4] ..... B41M 5/26

[52] U.S. Cl. ..... 428/423.1; 428/195; 428/447; 428/484; 428/488.1; 428/488.4; 428/913; 428/914

[58] Field of Search ..... 428/195, 484, 488.1, 428/488.4, 913, 914, 423.1, 447

[56] References Cited

U.S. PATENT DOCUMENTS 4,559,273 12/1985 Kutsukake et al. ..... 428/488.4

4,567,113 1/1986 Ohtsu et al. ..... 428/488.4

*Primary Examiner*—Bruce H. Hess

*Attorney, Agent, or Firm*—Parkhurst & Oliff

[57] ABSTRACT

A heat-resistant thermal transfer sheet comprising a base film provided on one surface thereof with a hot melt ink layer and with a heat-resistant protective layer on the other surface thereof. The heat-resistant protective layer is produced from a composition comprising (a) a thermoplastic resin having an OH or COOH group, (b) a polyamine or polyisocyanate, and (c) a thermoplastic resin, or a composition based on a silicone-modified resin. The heat transfer sheet of the present invention prevents sticking and blocking problems and makes it possible to carry out printing smoothly.

10 Claims, No Drawings

HEAT-RESISTANT, THERMAL-SENSITIVE TRANSFER SHEET

BACKGROUND OF THE INVENTION

This invention relates to an improved therma-sensitive transfer sheet (hereinafter referred to as thermal transfer sheet) applicable to recording wherein printing means employing short-period, high-temperature-heating, such as thermal heads, are used.

Heretofore, there has been known a thermal transfer sheet wherein one surface of a base or substrate made of a plastic film is provided with a transfer layer formed thereon and comprising a binder such as wax, and a coloring agent incorporated therein. In recent years, there has been an ever increasing trend towards high-speed printing. When a thermal transfer sheet is used in such a high-speed printing, the back surface of the thermal transfer sheet, i.e., the exposed plastic film surface is heated to its melting point or higher temperature. Consequently, the plastic film undergoes heat fusion to the printing equipment. That is, so-called "sticking phenomenon" is liable to occur. In order to overcome this "sticking phenomenon", several thermal transfer sheets have heretofore been proposed.

For example, Japanese Patent Publication No. 13359/1983 discloses a thermal transfer sheet wherein a heat-resistant protective film comprising at least one material selected from silicone resins, expoxy resins, melamine resins, phenol resins, fluorine resins, polyimide resins and nitrocellulose is provided on the back surface of the thermal transfer sheet. However, must of the resins used in the proposed technology are thermosetting resins, and therefore a heating step for curing is required during the formation of a protective film. Moreover, while the melting point of the protective film is high, the film per se is brittle. This interferes with smooth printing.

We have already proposed that the resins as described above be replaced with thermoplastic resins having an OH or COOH group and that a protective film be formed by adding an isocyanate and the like to the thermoplastic resins and curing the composition (Japanese Patent Application No. 71035/1982). According to this process, curing proceeds at approximately room temperature, and therefore an additional curing step is unnecessary. Thus, the protective film is readily formed. However, the slipperiness of the printing equipments is not yet entirely satisfactory, and there is a problem in that transfer cannot be carried out smoothly.

In general, a heat transfer sheet is mounted on a printing equipment in the rolled form and used in many cases. In such a rolled form, the ink layer of the heat transfer sheet comes into direct contact with the protective film, and therefore these layers may undergo heat fusion during storage at elevated temperatures (so-called blocking phenomenon). Such a blocking phenomenon may also be caused by changes in the environmental temperature and other conditions. Consequently, handling problems arise.

We have carried out studies in order to overcome the drawbacks and difficulties described above. It is an object of the present invention to provide a thermal transfer sheet wherein the sticking and blocking problems which occurred in the prior art can be effectively prevented, whereby printing can be smoothly accomplished.

SUMMARY OF THE INVENTION

The above stated object is achieved according to the present invention by providing thermal transfer sheet which comprises a hot melt ink layer provided on one surface of a base film and a heat-resistant protective layer having a specific composition which is provided on the other surface of the base film.

The above heat-resistant protective layer according to a first embodiment of the invention is produced from a composition comprising (a) a thermoplastic resin having an OH or COOH group, (b) a polyamine or polyisocyanate, and (c) a thermoplastic resin.

The above heat-resistant protective layer according to a second embodiment of the invention is produced from a composition based on a silicone-modified resin.

In either of the first and second embodiments described above, the heat-resistant protective layer may contain a lubricant or a heat releasing agent in order to improve mold releasability.

In a further embodiment of the present invention, a primer layer may be interposed between the base film and the heat-resistant protective layer in order to improve adhesion between these layers.

DETAILED DESCRIPTION OF THE INVENTION

Each constitutent material of the heat-resistant thermal transfer sheet of the present invention will now be described in detail. Throughout the following description, quantities of substances expressed in parts and percentage are by weight unless otherwise specified.

Base Film

A conventional base film can be used, as it is, as the base film for use in the present invention. Other films can be used. The base film of the present invention is not particularly restricted. Examples of the base film materials are: plastics such as polyester, polypropylene, cellophane, polycarbonate, cellulose acetate, polyethylene, polyvinyl chloride, polystyrene, nylon, polyimide, polyvinylidene chloride, polyvinyl alcohol, fluorine resins, rubber hydrochloride, and ionomers; papers such as capacitor paper, and paraffin paper; and nonwoven fabrics. Composite films of these materials may be also used.

The thickness of this base film can suitably vary depending upon the materials in order to obtain appropriate strength and thermal conductivity. The thickness of the base film is, for example, from 1 to 25 μm, preferably from 3 to 25 μm.

Hot Melt Ink Layer

A hot melt ink layer suitable for use in the present invention comprises a coloring agent and a vehicle, and may contain various additives as needed.

The coloring agents include organic and inorganic pigments and dyes. Preferred of these are pigments and dyes having good characteristics as recording materials, for example, those pigments and dyes having a sufficient color density and exhibiting no discoloration or fading under conditions such as light, heat and humidity.

The coloring agents may be materials which are colorless when they are not heated but form colors upon being heated. The coloring agents may be materials which form colors upon contacting a material contained in a transferable sheet. In addition to the coloring agents which form cyan, magenta, yellow and black, coloring agents having other various colors can be used. That is, the hot melt ink composition contains, as coloring agents, carbon black or various dyes or pigments selected according to the color which is desired to provide to the ink composition.

Waxes, drying oils, resins, mineral oils, celluloses, rubber derivatives, and the like, and mixtures thereof can be used as such vehicles.

Preferred examples of waxes are microcrystalline wax, carnauba wax and paraffin wax. In addition, representative examples of waxes which can be used include various waxes such as Fischer-Tropsch wax, various low molecular weight polyethylene and partially modified waxes, fatty acid esters, amides, Japan wax, bees wax, whale wax, insect wax, wool wax, shellac wax, candelilla wax, and petrolatum.

Examples of the resins which can be used include EVA (ethylene-vinyl acetate copolymers), EEA (ethylene-ethyl acrylate copolymers), polyethylene, polystyrene, polypropylene, polybutene, petroleum resins, vinyl chloride resins, polyvinyl alcohol, vinylidene chloride resins, methacrylic resins, polyamide, polycarbonate, fluorine resins, polyvinyl formal, polyvinyl butyral, acetyl cellulose, nitrocellulose, vinyl acetate resins, polyisobutylene, and polyacetal.

In order to impart good thermal conductivity and melt transferability to the ink layer, a thermal conductive material can be incorporated into the ink composition. Such materials include carbonaceous materials such as carbon black, and metallic powders such as aluminum, copper, tin oxide and molybdenum disulfide.

The hot melt ink layer can ve directly or indirectly applied as coating onto the base film by hot melt coating, ordinary printing or coating methods such as hot lacquer coating, gravure coating, gravure reverse coating, roll coating, gravure printing and bar coating, or many other procedures. The thickness of the hot melt ink layer should be so determined that a balance between the density of necessary printing and heat sensitivity is obtained. The thickness is in the range of from 0.1 to 30 μm, preferably from 1 to 20 μm.

Heat-Resistant Protective Layer

In the present invention, the heat-resistant protective layer has important functions, i.e., it prevents sticking and blocking during transferring and makes it possible to carry out smooth printing. This heat-resistant protective layer is formed on the base film surface on the side opposite that of the hot melt ink layer.

For the heat-resistant protective layer, the following two forms (I) and (II) can be used.

(I) A heat-resistant protective layer according to a first form is produced from a composition comprising (a) a thermoplastic resin having an OH or COOH group, (b) a polyamine or polyisocyanate, and (c) a thermoplastic resin.

The thermoplastic resins having an OH or COOH group are desirably selected from polyester resins, vinyl chloride-vinyl acetate copolymers, polyether resins, polybutadiene resins, acrylpolyols, urethane or epoxy prepolymers having hydroxyl groups, nitrocellulose resins, cellulose acetate propionate resins, cellulose acetate butyrate resins, cellulose acetate resins, and polyester polyols. The resins described above may be those resins having an OH or COOH group in their polymeric units, and those resins having an unreacted OH or COOH group at terminals or in side chains.

A polyisocyanate or polyamine is further added to the above thermoplastic resin having an OH or COOH group. Such a polyisocyanate or polyamine is added in order to cure the above thermoplastic resin having an OH or COOH group to obtain good antisticking performance.

Examples of the polyisocyanates which can be used in the present invention include: diisocyanates such as para-phenylenediisocyanate, 1-chloro-2,4-phenyldiisocyanate, 2-chloro-1,4-phenyldiisocyanate, tolylene-2,4-diisocyanate, tolylene-2,6-diisocyanate, 1,5-naphthalene diisocyanate, hexamethylene diisocyanate, and 4,4'-biphenylene diisocyanate; and triisocyanates such as triphenylmethane triisocyanate, and 4,4',4''-trimethyl-3,3',2''-triisocyanate-2,4,6-triphenylene isocyanurate. Examples of the polyamines which can be used in the present invention include melamin, methylated melamine, methylated methylol melamine, butylated melamine, butylated methylol melamine, dicyandiamide, guanidine, biquanide, cyanomelamine, guanylmelamine, urea, biuret, ammeline, ammelide, butylated urea, methylated urea, guanamines such as formoguanamine, acetoguanamine, benzoguanamine, phenylacetoguanamine, and methoxyguanamine, and N-methylolacrylamide copolymers.

When the polyamine described above is used as a crosslinking agent, ammonium phosphate, triethanolamine, acetamide, urea, pyridine, p-toluenesulfonic acid, surfanilic aid, guanidine stearate, guanidine carbonate or the like is used as a curing catalyst.

It is preferable that the polyisocyanate or polyamine be added in an amount of from 5 to 40 parts, preferably from 10 to 20 parts based on 100 parts of the thermoplastic resin having an OH or COOH group. If the amount of the polyisocyanate or polyamine is less than 5 parts, the degree of crosslinking/curing of the protective layer will be too low, whereby good results cannot be obtained. If the amount of the polyisocyanate or polyamine is more than 40 parts, the products obtained by reacting the polyisocyanate or polyamine itself will have no antisticking function. Thus, the use of such amounts outside of the above stated limits is undesirable.

The addition of the crosslinking agent described above to the thermoplastic resin having an OH or COOH group improves the adhesion of the protective layer to a base film as compared with the crosslinking agent-free layer.

The thermoplastic resins which are used in order to form the heat-resistant protective layer can be selected from a wide range of thermoplastic resins. Suitable examples of these thermoplastic resins are acrylic resins, polyester resins, vinylidene fluoride resins, vinylidene fluoride-tetrafluoroethylene copolymer resins, polyvinyl fluoride resins, acrylnitrile-styrene copolymer resins, acryl-vinyl chloride copolymer resins, nitrile rubbers, nylons, polyvinyl carbazole resins, chlorinated rubbers, cyclized rubbers, polyvinyl acetate resins, polyvinyl chloride resins, and vinyl chloride-vinyl acetate copolymer resins. It is empirically known that these resins preferably have a glass transistion point of at least 60° C.

(II) A heat-resistant protective layer according to the aforementioned second form is produced from a composition based on a silicone-modified resin.

Taking into account the coating properties (such as adhesion of the protective layer to the base film, and the like) and film-forming properties, a modified resin comprising a silicone resin and another thermoplastic or thermosetting resin having good compatibility therewith is preferably used.

The thermoplastic or thermosetting synthetic resin in the coating composition from which the heat-resistant protective layer is to be produced can be ordinarily selected by considering its affinity for a plastic film which constitutes the base described above and its compatibility with a silicone resin. Representative examples of the thermoplastic or thermosetting resins which can be used in the present invention include acrylic resins, epoxy resins, melamine-formaldehyde resins, urea-formaldehyde resins, dioctyl phthalate, ethyl cellulose, phenol resins, rosin-modified phenol resins, polyester resins, epoxy ester resins, alkyd resins, and styrenated alkyd resins.

The heat-resistant protective layer is produced from each compound described above by dissolving the compound in a suitable solvent, adjusting the solution to a viscosity suitable for application, and then applying the solution as a coating onto one surface of a base film by any of known coating methods.

Primer Layer

While the thermal transfer sheet of the present invention fundamentally has the constitution described above, the modifications such as the following may be further made.

For example, a primer layer may be interposed between the base film and the protective layer in order to improve the adhesion therebetween. The primer layer can be provided by using known primer coating compositions. For example, acrylic resins, polyester resins, polyvinyl acetate resins, vinyl chloride-vinyl acetate resins, polyols/diisocyanates, polyols/melamine, epoxy resins/diisocyanates or the like may be used as a binder. The use of the primer coating composition containing such a binder can improve adhesion particularly when a polyester film is used as the base film.

Lubricant or Heat Mold Releasing Agent

A lubricant or heat mold releasing agent may be added into the heat-resistant protective layer in order to improve the slipperiness of the printing head. Examples of the lubricants or heat mold releasing agents include: a first group selected from waxes such as polyethylene wax, and paraffin wax, higher fatty acid amides, higher fatty acid esters, higher fatty acid salts, higher alcohols, and phosphoric esters such as lecithin; and a second group selected from powders of fluorine resins (such as Teflon), vinyl fluoride resins, and guanamine resins and boron nitride, silica, wood powders, and talc.

The lubricants or heat mold releasing agents, described above can be optionally used in the form of mixtures thereof. It is desirable that the lubricant or heat mold releasing agent be added into the protective layer in an amount of from about 10% to about 50%. The addition of such a lubricant or heat mold releasing agent is carried out by adding and kneading it in preparing a coating composition from which the protective layer is produced. A compound of the first group melts melts on heating to act as a lubricant or a mold releasing agent, whereas a compound of the second group acts as a lubricant or heat mold releasing agent in the state of solid particles.

In order to indicate more fully the nature and utility of this invention, the following examples are set forth, it being understood that these examples are presented as illustrative only and are not intended to limit the scope of the invention. All parts used herein are by weight unless otherwise specified.

In the following examples, the following base film and hot melt ink layer were commonly used.

Base Film

Polyethylene terephthalate films having a thickness of 6 μm or 12 μm (manufactured by TORAY INDUSTRIES, INC., Japan) were used as base films.

Hot Melt Ink Layer

A hot melt ink layer was prepared by kneading an ink composition comprising the following components for 6 hours by means of a blade kneader while the composition was warmed at a temperature of 90° C.

| | |
|---|---|
| Paraffin wax | 10 parts |
| Carnauba wax | 10 parts |
| Polybutene (VH-100, manufactured by NIPPON SEKIYU K.K., Japan) | 1 part |
| Carbon black (Siest S, manufactured by TOKAI DENKYOKU, K.K., Japan) | 2 parts |

After a heat-resistant protective layer described hereinafter was applied to one surface of a base film, the ink composition described above was heated to a temperature of 100° C. and applied as a coating onto the other surface of the base sheet to a coating thickness of 5 μm by a roll coating method to form a hot melt ink layer.

EXAMPLE 1

The following composition (A) was prepared.

Composition A

| | |
|---|---|
| Acrylonitrile-styrene copolymer resin (Sebian N, manufactured by DAICEL KAGAKU, LTD., Japan) | 8 parts |
| Acrylpolyol (TP-5000; 50% solution; solvents: ethyl acetate, toluene, MEK and MIBK; manufactured by DENKA POLYMER, Japan) | 32 parts |
| Teflon powder (Rupron L, manufactured by DAIKIN KOGYO, K.K., Japan) | 3 parts |
| Polyethylene wax (Mark FC-113, manufactured by ADEKA ARGUS CHEMICAL CO., LTD.) | 3 parts |
| Toluene | 40 parts |
| MEK | 40 parts |

An isocyanate (Takenate D-204; 50% butyl acetate solution; manufactured by Takeda Yakuhin Kogyo, K.K., Japan) was added to the composition (A) described above at a weight ratio of composition (A) to Isocyanate of 12:3 immediately before coating, and the mixture was applied as a coating onto the base film surface opposite that of the hot melt ink layer to a coating thickness of 1 μm on a dry basis by a gravure printing method. The whole sheet was dried at a temperature of 100° C. to form a protective layer.

EXAMPLE 2

In order to form a heat-resistant protective layer, the following composition (B) was prepared.

Composition B

| | |
|---|---|
| Vinylidene fluoride-tetrafluoroethylene copolymer (Kainer 7201, manufactured by Pennwalt Corporation) | 8 parts |
| Polyester polyol (Takerak XU-534 TV; 40% MEK solution; manufactured by Takeda Yakuhin Kogyo, K.K., Japan) | 40 parts |
| Fluorocarbon (MOLD WIZ F-57, manufactured by Accell) | 5 parts |
| Benzoguanamine resin powder (Epostar S, manufactured by NIPPON SHOKUBAI KAGAKU KOGYO CO., LTD., Japan) | 3 parts |
| Lecithin (manufactured by Ajinomoto Co., Inc., Japan) | 1 part |
| MEK | 35 parts |
| Toluene | 45 parts |

The procedure of Example 1 was repeated except that an isocyanate (Collonate L; 75% ethyl acetate solution; manufactured by Nippon Polyurethane, Japan) was admixed into the compositon (B) in a weight ratio of composition (B) in isocyanate of 14:3.

EXAMPLE 3

In order to form a heat-resistant protective layer, the following composition (C) was prepared.

Composition (C)

| | |
|---|---|
| Methyl methacrylate resin (Thermolach M-116A; 10% toluene solution; manufactured by Sohken Kagaku, Japan) | 100 parts |
| Acrylpolyol (Thermolack U-230; 50% toluene/butyl acetate solution; manufactured by Sohken Kagaku, Japan) | 10 parts |
| Polyethylene wax (AF wax, manufactured by BASF) | 2.5 parts |
| Talc (Microace L-1, manufactured by Nippon Talc, Japan) | 2 parts |
| Fluorocarbon (MOLD WIZ F-57, manufactured by Accell) | 4 parts |
| MEK | 30 parts |
| Toluene | 20 parts |

The procedure of Example 1 was repeated except that an isocyanate (Takenate D-110N; 75% ethyl acetate solution; manufactured by Takeda Yakuhin Kogyo, K.K., Japan) was admixed into the composition (C) in a weight ratio of composition (C) to isocyanate of 20:3.

EXAMPLE 4

In order to form a heat-resistant protective layer, the following composition (D) was prepared.

Composition (D)

| | |
|---|---|
| Vinyl chloride-vinyl acetate copolymer resin (Vinyllite VYHH, manufactured by Union Carbide Company) | 3 parts |

-continued

| | |
|---|---|
| Cellulose acetate propionate (CAP 482-05, manufactured by Eastman Kodak) | 13 parts |
| Hexamethoxymethylated melamine (Nikarack MW-30, manufactured by Sanwa Chemical, Japan) | 13 parts |
| Saccharose acetate isobenzonide (manufactured by Eastman Chemical) | 3.6 parts |
| Methyl cellosolve | 20 parts |
| Butyl acetate | 20 parts |
| MEK | 20 parts |

The procedure of Example 1 was repeated except that a 40% IPA solution of p-toluenesulfonic acid was admixed into the composition (D) in a weight ratio of composition (D) to IPA solution of 45:1.

EXAMPLE 5

In order to form a heat-resistant protective layer, the following composition (E) was prepared.

Composition (E)

| | |
|---|---|
| 40% Xylene solution of silicone-modified acryl resin ("KR5208", manufactured by Shin-Etsu Kagaku, K.K., Japan) | 10 parts |
| Toluene | 25 parts |
| Xylene | 25 parts |
| Butanol | 10 parts |

The composition described above was applied as a coating onto the base film surface opposite that of the hot melt ink layer to a coating thickness of 1 $\mu$m on a dry basis by a gravure printing method and dried at a temperature of 100° C. to form the protective layer.

EXAMPLE 6

In order to form a heat-resistant protective layer, the following composition (F) was prepared.

Composition (F)

| | |
|---|---|
| 50% Xylene solution of silicone-modified polyester resin ("KR5203", manufactured by Shin-Etsu Kagaku, K. K., Japan) | 10 parts |
| Fluorocarbon (F-57, manufactured by Accell) | 4 parts |
| Toluene | 25 parts |
| Xylene | 25 parts |

The composition (F) described above was applied in the same manner as described in Example 5 to form the heat-resistant protective layer on the base film.

Comparison of Test Results

Samples obtained in Examples 1 through 6 described above and a reference sample having no heat-resistant protective layer (Comparative Example) were prepared. The head traveling characteristic during printing under the following conditions and the state of the samples after printing were observed.

Printing equipment used: Thin film-type thermal head

Printing energy: 1 mJ/dot (the area per each dot is $4\times10^{-4}$ cm$^2$).

Transferable sheet (sheet to be transferred): wood-free paper, manufactured by Sanyo-Kokusaku Pulp Co., Ltd., Japan (KYP twelvemo; 135 kg)

Thickness of Base film

| | 6 μm | 12 μm |
|---|---|---|
| Example 1 | no hindrance | no hindrance |
| Example 2 | no hindrance | no hindrance |
| Example 3 | no hindrance | no hindrance |
| Example 4 | no hindrance | no hindrance |
| Example 5 | no hindrance | no hindrance |
| Example 6 | no hindrance | no hindrance |
| Comp. Example | sticking, perforation and rupture | sticking and perforation |

Samples of Examples 5 and 6 and the Comparative Example were subjected to a blocking test.

The blocking test was carried out by setting thermal transfer sheets in a rolled form, preserving them for one week at a temperature of 70° C., and examining the same for the presence of blocking.

In the Comparative Example, blocking was observed. In Examples 5 and 6, no blocking was observed.

As can be seen from the Examples described above, the heat-resistant thermal transfer sheet of the present invention has the following features of utility.

(a) Since the thermal transfer sheet of the present invention has a heat-resistant protective layer having a specific composition thermal printing can be attained without occurrence of any sticking and blocking which have been problems in the prior art. Further, it is possible to maximally utilize the inherent merits of base-forming plastic films such as good resistance to cutting and good processability.

(b) The heat-resistant protective layer according to the present invention can be relatively easily formed by means of conventional coaters or applicators, and an additional high temperature heat treatment is unnecessary. Accordingly, the present invention is also advantageous in respect of the simplification of the process.

(c) The relative slipperiness of the printing equipment is considerably improved and therefore the printing operation can proceed smoothly.

What is claimed is:

1. A heat-resistant thermal transfer sheet comprising a base film, a hot melt ink layer provided on one surface of the base film, and a heat-resistant protective layer provided on the other surface of said base film;

said heat-resistant protective layer being produced from a composition comprising (a) a first thermoplastic resin having an OH or COOH group, (b) a polyamine or polyisocyanate, and (c) a second thermoplastic resin selected from the group consisting of acrylic resins, polyester resins, vinylidene fluoride resins, vinylidene fluoride-tetrafluoroethylene copolymer resins, polyvinyl fluoride resins, acrylonitrilestyrene copolymer resins, acryl-vinyl chloride copolymer resins, nitrile rubbers, nylons, polyvinyl carbazole resins, chlorinated rubbers, cyclized rubbers, polyvinyl acetate resins, polyvinyl chloride resins, and vinyl chloride-vinyl acetate copolymer resins, wherein said first thermoplastic resin and said second thermoplastic resin comprise different resins.

2. A thermal transfer sheet according to claim 1, wherein said heat-resistant protective layer further contains a lubricant or heat mold releasing agent.

3. A thermal transfer sheet according to claim 1, wherein said first thermoplastic resin having an OH or COOH group is selected from the group consisting of polyester resins, vinyl chloride-vinyl acetate copolymers, polyether resins, polybutadiene resins, acryl-polyols, urethane or epoxy prepolymers having OH groups, nitrocellulose resins, cellulose acetate propionate resins, cellolose acetate butyrate resins, cellulose acetate resins and polyester polyols.

4. A thermal transfer sheet according to claim 1, wherein said polyamine is selected from the group consisting of melamine, methylated melamine, methylated methylol melamine, butylated melamine, butylated methylol melamine, dicyandiamide, guanidine, biguanide, cyanomelamine, guanylmelamine, urea, biuret, ammeline, ammelide, butylated urea, methylated urea, guanamines including formoguanamine, acetaguanamine, benzoguanamine, phenylacetoguanamine, and methoxyguanamine, and N-methylolacrylamide copolymers.

5. A thermal transfer sheet according to claim 1, wherein said polyisocyanate is a diisocyanate or a triisocyanate.

6. A heat transfer sheet according to claim 1, wherein said polyisocyanate is selected from the group consisting of para-phenylenediisocyanate, 1-chloro-2,4-phenyldiisocyanate, 2-chloro-1,4-phenyldiisocyanate, tolylene-2,4-diisocyanate, tolylene-2,6-diisocyanate, 1,5-naphthalene diisocyanate, hexamethylene diisocyanate, 4,4'-biphenylene diisocyanate, triphenylmethane triisocyanate, and 4,4',4''-trimethyl-3,3',2''-triisocyanate-2,4,6-triphenylene isocyanurate.

7. A thermal transfer sheet according to claim 2, wherein said lubricant or heat mold releasing agent is selected from the group consisting of waxes, higher fatty acid amides, higher fatty acid esters, higher fatty acid salts, higher alcohols, phospholipids, and phosphoric esters.

8. A heat-resistant thermal transfer sheet comprising a base film, a hot melt ink layer provided on one surface of the base film, and a heat-resistant protective layer provided on the other surface of said base film;

said heat-resistant protective layer comprising a silicone-modified resin produced from a silicone resin and a resin selected from the group consisting of acrylic resins, epoxy resins, melamine-formaldehyde resins, urea-formaldehyde resins, dioctyl phthalate, ethyl cellulose, phenol resins, rosin-modified phenol resins, polyester resins, epoxy ester resins, alkyd resins, and styrenated alkyd resins.

9. A thermal transfer sheet according to claim 8, wherein said heat-resistant protective layer further contains a lubricant or heat mold releasing agent.

10. A thermal transfer sheet according to claim 1, wherein a primer layer is interposed between the base film and the heat-resistant protective layer.

* * * * *